United States Patent [19]

Emrich

[11] Patent Number: 4,965,945

[45] Date of Patent: Oct. 30, 1990

[54] EXCAVATING TOOTH

[75] Inventor: Robert K. Emrich, Portland, Oreg.

[73] Assignee: ESCO Corporation, Portland, Oreg.

[21] Appl. No.: 309,309

[22] Filed: Feb. 10, 1989

Related U.S. Application Data

[63] Continuation-in-part of Ser. No. 155,892, Feb. 16, 1988, Pat. No. 4,811,505, which is a continuation of Ser. No. 937,982, Dec. 4, 1986, Pat. No. 4,761,900.

[51] Int. Cl.[5] ..... E02F 9/28

[52] U.S. Cl. ..... 37/142 R; 37/142 A

[58] Field of Search ..... 37/142 R, 142 A

[56] References Cited

U.S. PATENT DOCUMENTS

| | | | |
|---|---|---|---|
| 1,808,311 | 6/1931 | Madonna | 37/142 R |
| 1,845,677 | 2/1932 | Mekeel | 37/142 R |
| 2,919,506 | 1/1960 | Larsen | 37/142 R |
| 3,079,710 | 3/1963 | Larsen et al. | 37/142 R |
| 3,839,805 | 10/1974 | Stepe | 37/142 R |
| 4,182,058 | 1/1980 | Poncin | 37/142 A |
| 4,326,348 | 4/1982 | Emrich | 37/142 R |
| 4,335,532 | 6/1982 | Hahn et al,. | 37/142 R |
| 4,761,900 | 8/1988 | Emrich | 37/142 R |

*Primary Examiner*—David A. Wiecking
*Assistant Examiner*—Huong Q. Pham
*Attorney, Agent, or Firm*—Tilton, Fallon, Lungmus & Chestnut

[57] ABSTRACT

An excavating tooth having a socket-equipped point mounted on an adapter nose and secured with a vertical pin on one side of the nose, the nose being grooved for receipt of the pin and equipped with a resilient keeper extending transversely of the point length, the point having a least one side wall extending rearwardly beyond the socket, the side wall having integral, vertically spaced apart lug portions having forwardly facing surfaces bearing against the pin, the nose groove providing a rearwardly facing surface bearing against the pin intermediate the lug bearing surfaces.

12 Claims, 3 Drawing Sheets

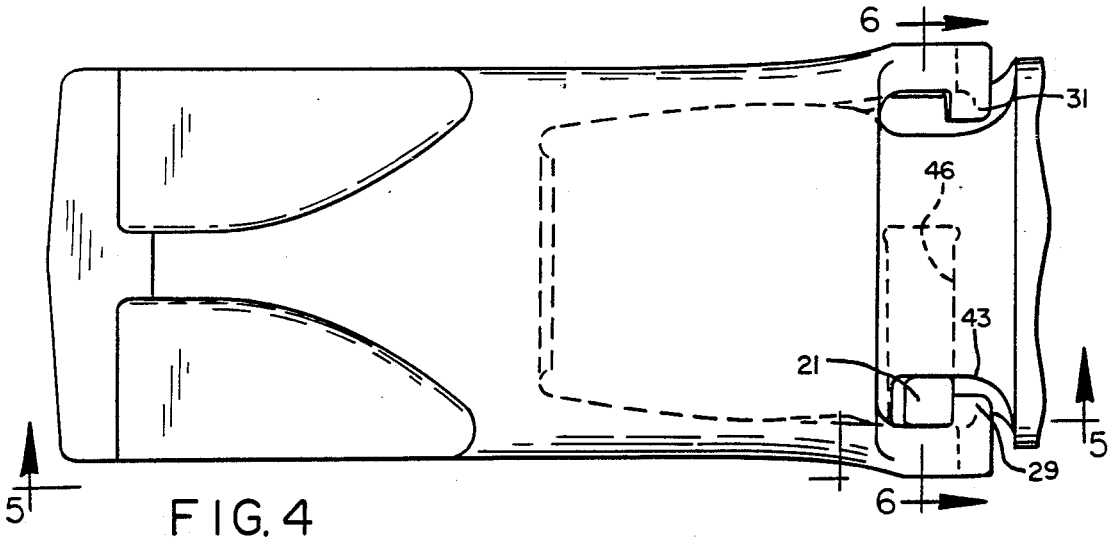
FIG. 4
FIG. 5
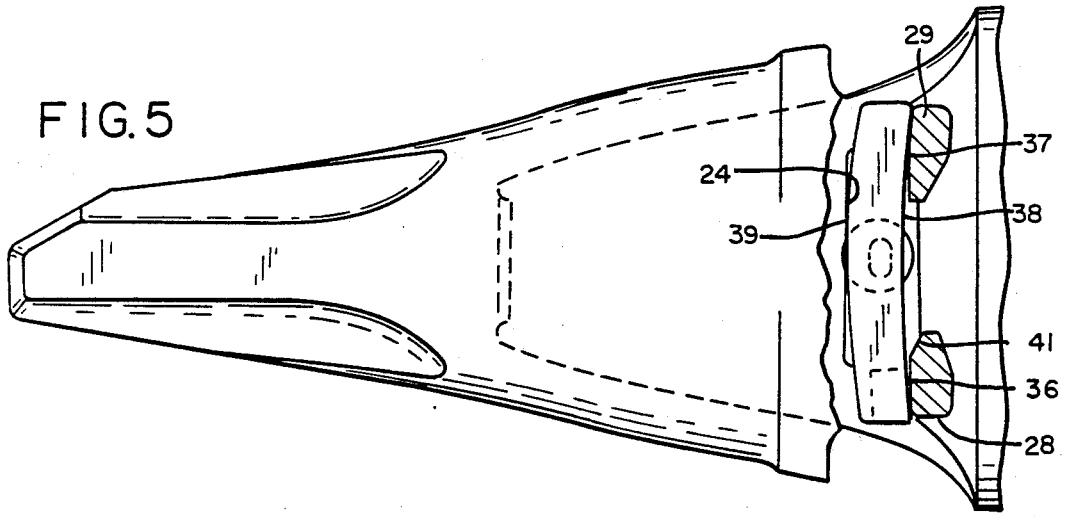
FIG. 7
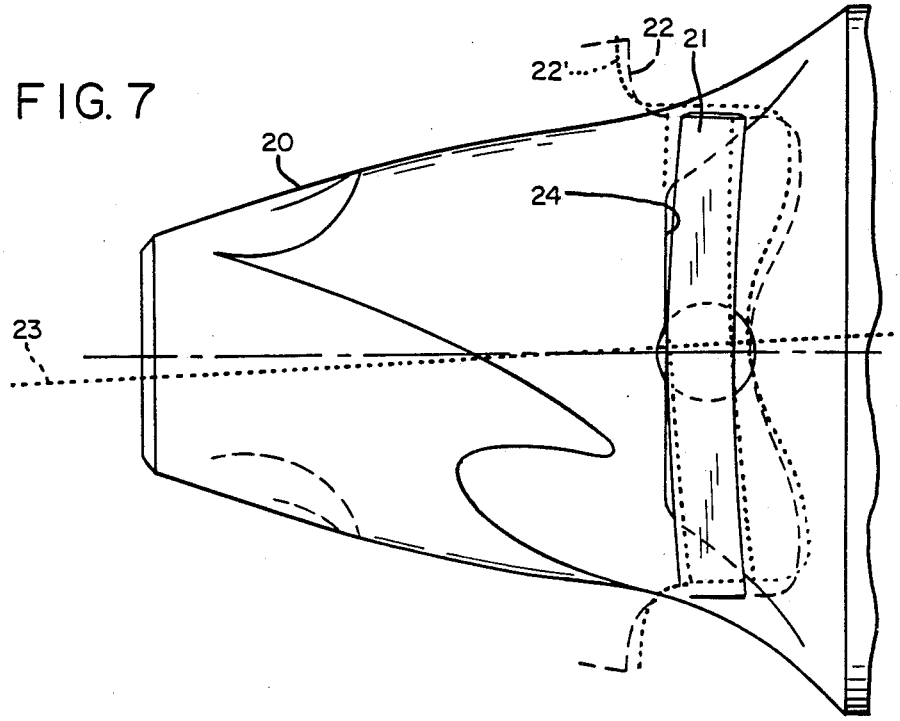

EXCAVATING TOOTH

This application is a continuation-in-part of my application Ser. No. 155,892 now U.S. Pat. No. 4,811,505 filed Feb. 16, 1988 which, in turn, was a continuation of application Ser. No. 937,982 filed Dec. 4, 1986, now U.S. Pat. No. 4,761,900.

BACKGROUND AND SUMMARY OF INVENTION

This invention relates to an excavating tooth and more particularly to a novel point portion thereof, being an improvement on U.S. Pat. No. 4,761,900 which, in turn, was an improvement on co-owned U.S. Pat. No. 4,353,532.

In the '900 patent, a novel locking system was provided to replace the U-shaped fastener employed in the HELILOK® tooth sold throughout the world—see '532 patent. The '900 system employed a drive through pin maintained in place by a plug member or keeper which extended transversely of the adapter length, i.e., horizontally so as to be unstressed by impact loads. The vertical locking pin in the '900 patent was clamped in place by an ear lug on the point rear cooperating with a pair of vertically spaced ears on the adapters. These cooperated to retain the pin which was generally arched rearwardly, i.e., the convex side faced rearwardly.

I have determined that a significant improvement in operation can be achieved by employing a pair of vertically spaced ear lugs on the point ear, notwithstanding the pin convexity.

Through employing the spaced ear lugs on the point, a point and nose assembly configuration providing improved service life of the nose has been created. In explanation, the end of service life of any excavating tooth system nose is determined most commonly by one or the other of two types of failures:

1. Failure of the nose to retain points, which has been brought about by a wearing away of the nose through service to create a fit of points on the nose that is so loose that the points either fall off or break off.

2. Structural failure of the nose in a fatigue mode. The improved nose service life provided by the inventive point and nose construction results from reductions in the causes of both types of failures.

With regard to nose wear, the inventive construction reduces bearing pressures of the point on the nose by providing a longer bearing surface, thereby slowing the rate of nose wear and resultant loosening of point fits. Also, it provides for a "rocking" type bearing of the point retaining pin against the nose to reduce wear of the pin bearing surface on the nose. Whereas the '900 pin is caused to rub against the nose ears through small movements up and down that are induced by the point under loading, the spaced ear lugs of the inventive point permit a pin configuration that can absorb the point induced movement through rocking. This rocking movement equates to a slower rate of wear on the pin bearing surface of the nose in comparison to the '900 construction, as with the simple analogy of the rolling wheel versus the sliding block. Further the inventive construction provides that the rear sidewalls of the point completely protect the nose pin bearing surface and the pin itself from all external wear, that is, wear from abrasive soil and rock which the tooth system is excavating.

It is axiomatic that a tight fit is desired to keep the point in place on the adapter—this notwithstanding the fact that under high impact loads there is movement of the point relative to the adapter nose (see U.S. Pat. Nos. 2,919,506 and 3,079,710), tightness is relative. The basic HELILOK tooth system of U.S. Pat. No. 4,335,543 is capable of supporting and retaining points on the nose after a considerable amount of looseness has developed from nose wear. It is superior to other tooth systems in this respect, as are the '900 tooth system and the inventive tooth system. Yet, there is a threshold of looseness, which will vary inversely with the severity of application, beyond which a given tooth system will not be capable of supporting and retaining points. It is the extension of the amount of service before this threshold is reached toward which the inventive tooth is directed.

With regard to nose fatigue failures, the use of spaced apart ear lugs on the point permits elimination of projecting ears on the nose. Such projecting ears can be a source of stress concentration. Hence their elimination provides greater nose fatigue strength as well as allowing a longer bearing surface. These two advantages more than compensate for the slight loss of material in the nose to provide the groove for the new side lock pin.

The principal advantages reside in the achievement of heretofore unrealizable tighter fits throughout the adapter life and the avoidance of stress concentrations at the critical juncture of the nose with the shank portion of the adapter while achieving a greater point to nose bearing length.

Points with vertically spaced rearwardly extending ear-like portions have been used previously, as in my prior U.S. Pat. No. 4,326,348 where the ear function was for stabilization in cooperation with a ear cap.

The prior art does not teach the advantageous function of the spaced-apart rearwardly extending ear means in confining the locking pin in original locked position.

The invention is described in conjunction with the accompanying drawing, in which FIG. 1 is an exploded perspective view of U.S. Pat. No. 4,335,532;

FIG. 2 is an exploded perspective view of U.S. Pat. No. 4,761,900;

FIG. 4 is a top plan view of the assembled elements of the instant invention;

FIG. 5 is a side elevational view, partially broken away and in section of the assembly of FIG. 4 with the section corresponding to the view along line 5—5 of FIG. 4;

FIG. 7 is a fragmentary side elevational view of the nose with the point shown in non-impact and impact conditions;

DETAILED DESCRIPTION

Figure 1:
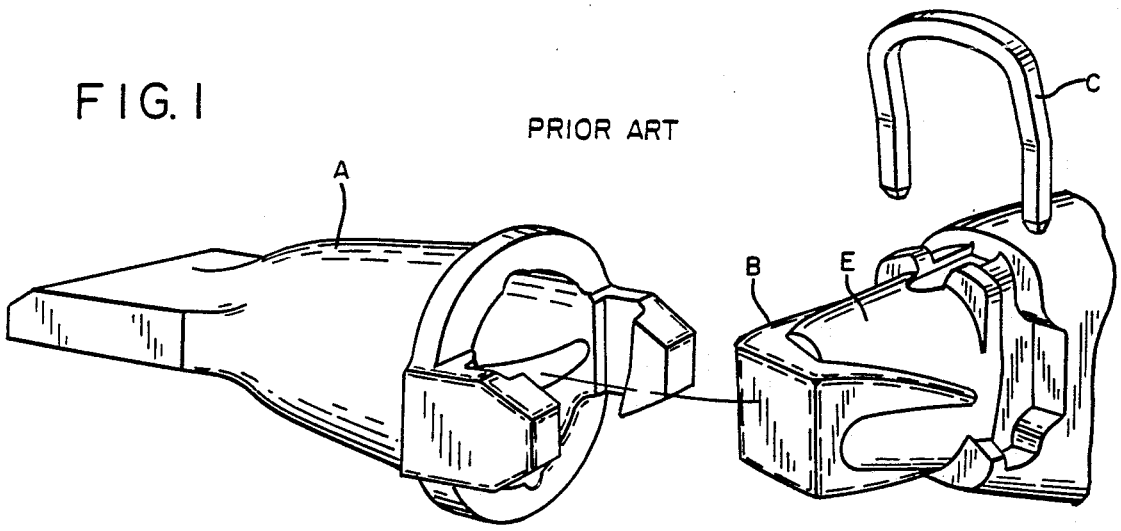
FIG. 1 PRIOR ART

Referring to FIG. 1, the HELILOK® tooth of the '532 is pictured. This consists of a point A, an adapter having a nose portion B, and a U-shaped lock C. This tooth construction was especially advantageous in providing a stronger nose because of the absence of any locking pin opening.

Figure 2:
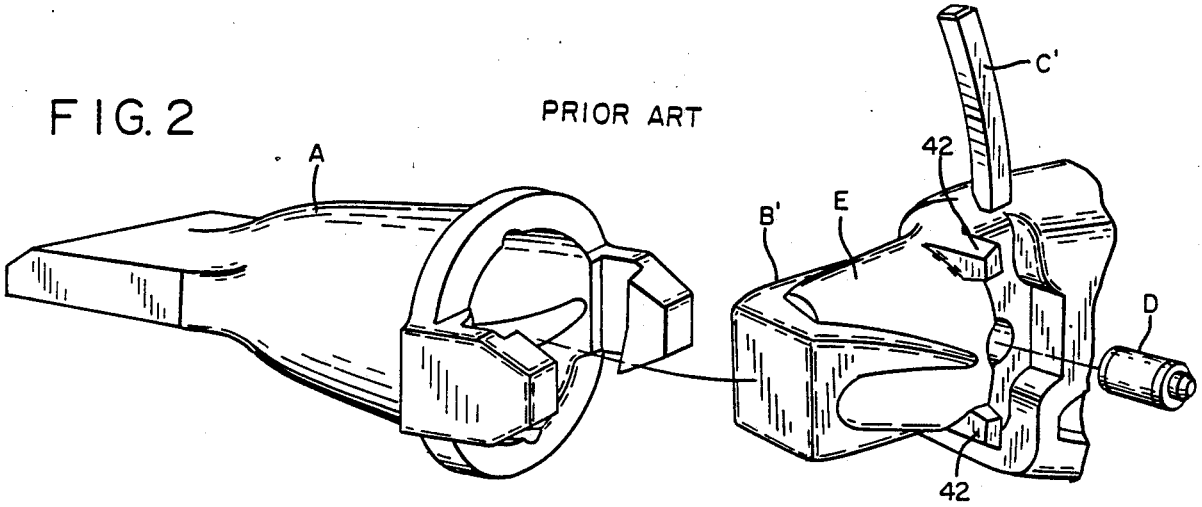
FIG. 2 PRIOR ART

However, there has been difficulty on occasion in removing the U-shaped lock C which was overcome by the use of the drive-through pin C' of the '900 patent—see FIG. 2. An especially advantageous feature of the '900 patent construction was the use of an unstressed keeper or transverse plug D. The tooth point of FIG. 2 is designated A because it is identical to that of FIG. 1. However, the adapter nose of FIG. 2 was changed from that of FIG. 1 and therefore is designated B'. As indicated above, the lock was changed also and therefore the drive-through pin of FIG. 2 is designated C'.

According to the instant invention, I have changed all of the point, adapter nose and pin lock, these being designated A', B'' and C''—the keeper being unchanged and therefore designated D.

The invention is based on the discovery that the pin normally moves with the point when the latter is under impact loading. This can be appreciated from the diagrammatic showing in FIG. 7. There, the adapter nose is shown in solid line and is designated 20. The locking pin is also shown in solid line and is designated 21 in the non-impact condition. The tooth point, however, is shown in dashed line, designated 22 and also is in the non-impact or static condition.

An impact load or stress—directed downwardly as schematically indicated at 23—causes the point to pivot on the nose to the dotted line configuration designated 22'. The pin likewise pivots to the dotted line position designated 21'. This illustrates the rocking or rolling action referred to previously—and which provides the advantage of not wearing the surface 24 of the nose groove that bears on the intermediate portion of the pin 21, see also FIG. 5.

To take advantage of the discovery that the pin moves with the point in the system under construction, I made several changes in the locking mechanism, an important one being the provision of spaced-apart pin bearing surfaces on the point.

POINT LUGS BEARING ON PINS

Figure 3:
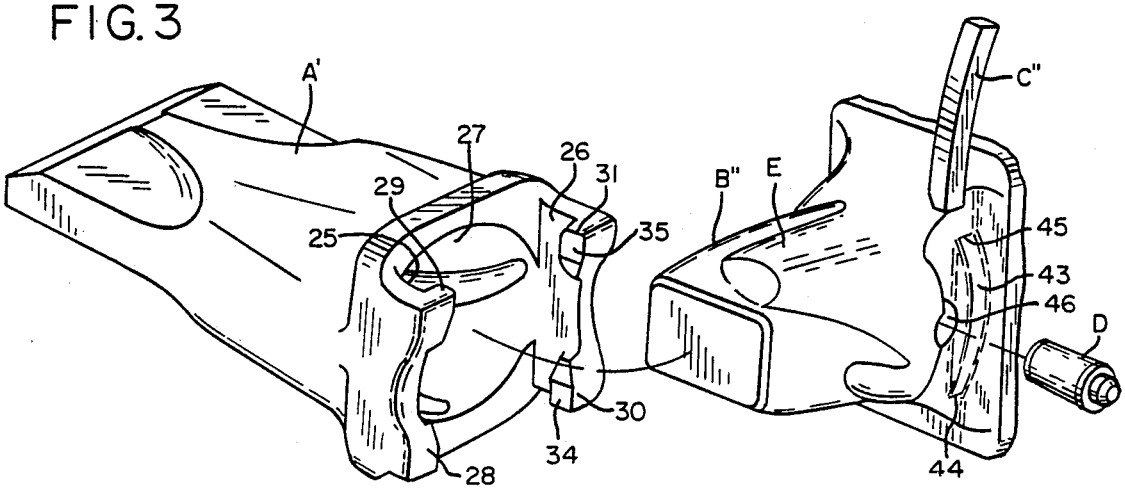
FIG. 3 is an exploded perspective view of the tooth parts of the instant invention.

These can be first appreciated from a consideration of FIG. 3. In that embodiment the sidewalls of the point A' are extended rearwardly beyond the socket 27 to provide ears 25 and 6. At their rearward ends, these ear portions or means are equipped with integral lugs 28, 29 for the ear 25 and 30, 31 for ear 26. The lug 29 can be seen in the lower right-hand portion of FIG. 4 and the lug 31 is seen in the upper right-hand portion of that view. All of these lugs are also designated in FIG. 6. These lugs are inwardly projecting and by that I refer to extending at approximately a right angle to the length of the socket 27, i.e., the interior of the tooth.

Figure 6:
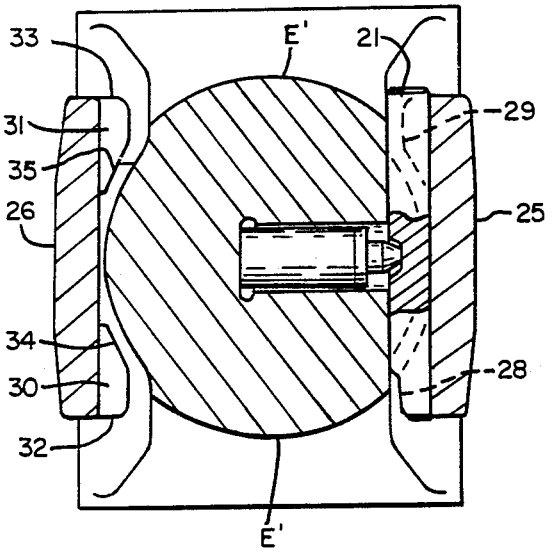
FIG. 6 is a sectional view such as would be seen along the sight-line 6—6 as applied to FIG. 4.

From FIG. 6, it can be seen that the vertical distance between the top 33 of the upper lug 31 and the bottom 32 of the lower lug 30 is approximately the length of the rear diameter of the socket 27 which has a circular cross-section at its rear end, i.e., in the "nose cone" surface at E in FIGS. 1–3.

This relationship is advantageous in that it permits adequate size of the integral lugs from the standpoints of structural strength and bearing area.

In explanation, the inward surfaces 34 and 35 of the lugs 30 and 31 as seen in FIG. 6 (and correspondingly on the lugs 28 and 29) are partly bevelled surfaces located for minimum clearance around the nose cone surface E in FIG. 3. This can be seen most clearly in FIG. 6, where the surfaces E' are extensions of the nose cone rearward to the region of FIG. 6. In the twisting assembly and disassembly of the point on the nose, these inward, beveled surfaces of the lugs must clear the nose cone and extension surfaces, E and E'. By combining the flat tall point ears of FIGS. 3–7 with the circular socket/nose cone cross section, I arranged for space outside of this inward boundary for point ear lugs of adequate size.

In the specific invention, the inward beveled surfaces 34, 35 of the ear lugs actually are arcuate, but satisfactory function could be achieved with straight bevels.

Referring to FIG. 5, in the preferred construction, the pair of forwardly facing lug walls 36 and 37 together are portions of an arcuate surface for tightening engagement with longitudinally spaced areas of the concave rear edge 38 of the pin 21. Only one pair of lugs engage the pin on any given assembly, the other pair being for the purpose of allowing installation of the point in 180° turned orientation. This practice of turning points when they are about half worn out is sometimes practiced when a very sharp digging configuration is required.

Figure 8:
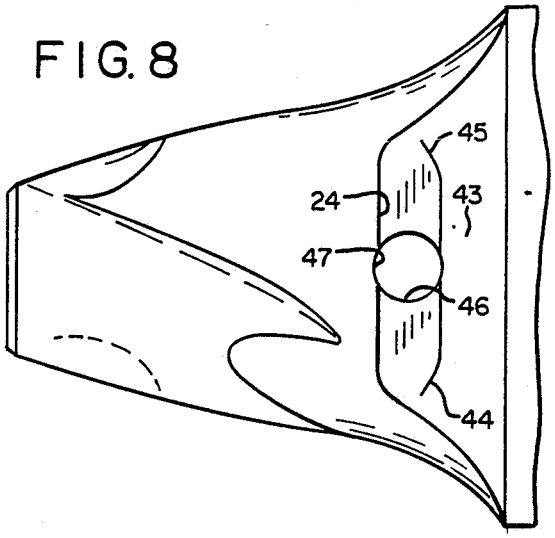
FIG. 8 is a side elevational view of the adapter nose portion of the embodiment of the invention depicted in FIGS. 3–7.
Figure 10:
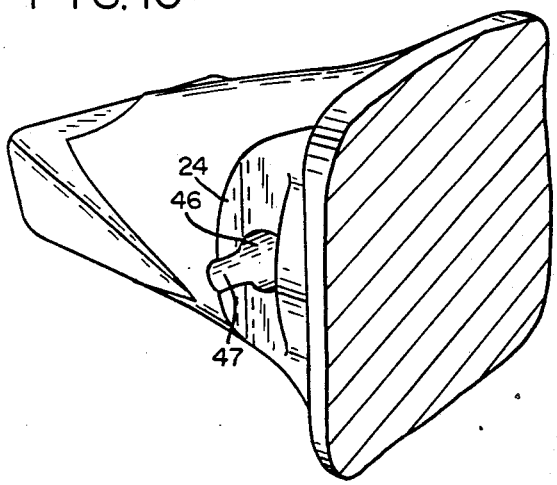
FIG. 10 is a perspective view of the nose of FIG. 8 as seen from the left rear.

Prior to assembly, the radius of the concave rear edge 38 of the pin 21 is smaller than the radius of the arc surface pairs 36, 37 or those corresponding pairs on lugs 28 and 29. Therefore, if the pin 21 is placed in contact with the lug 21 arc surface 36, 37, but not in assembly on a nose, the contact is locally near the ends of the lug surfaces as at 32 and 33. With assembly of the pin into a point and nose assembly, this contact of the pin on the lug arc surfaces becomes more distributed because the pin is caused to flex through the contact of its forward convex edge 39 with the forward wall 24 of the nose groove 40—see FIGS. 5, 8 and 10. Finally, under operating loads received on the point during service, the pin is able to flex still more so that the radius of its concave rear edge 38 essentially matches that of lug arc surfaces 36, 37 for full surface contact.

It, of course, is the flexing of the pin that creates a tightening assembly force.

Driving of the pin into the point/nose assembly is facilitated by a bevel interruption of the forwardly facing lug wall 36 as at 41 in FIG. 5. As the entry end of the pin 21 passes over this bevel 41, the pin is caused to deflect, or flex, in order to arrive at the forwardly facing lug wall 36.

NOSE BEARING ON PIN

Figure 9:
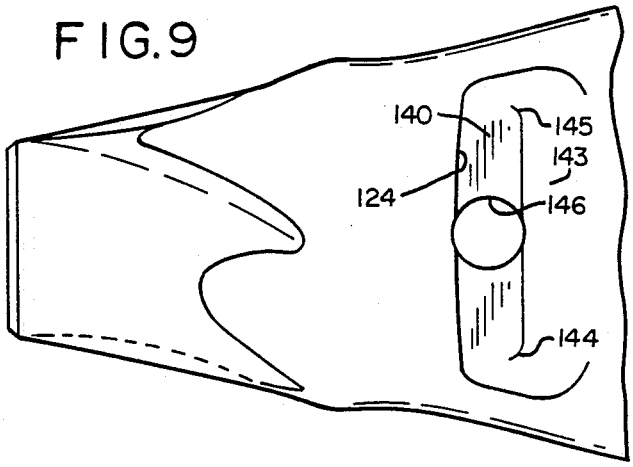
FIG. 9 is a view similar to FIG. 8 but of another embodiment of the invention wherein the surface of the nose bearing against the pin is arcuate.

Instead of using the ears 42 of FIG. 2 for bearing on the new pin C'', I employ the forward wall 24 of the nose groove 40—see FIGS. 4 and 5. The nose bearing surface is planar as at 24 in FIG. 8 or slightly arcuate as at 124 in FIG. 9 relative to the groove 140. Nominally, the pin bears on the nose surfaces at 24, 124 near the longitudinal mid-plane of the nose, but during impact stress the bearing shifts above and below the mid-plane.

The groove 40 in the nose is defined insofar as its rear wall is concerned by an integral ledge 43—compare FIGS. 3 and 4. This ledge merges top and bottom into the nose as can be appreciated from the showings at 44 and 45 in FIGS. 3 and 8 and at 144 and 145 in FIG. 9 relative to the ledge 143. The arcuity of the forward wall 124 of FIG. 9 can be appreciated from the fact that at its mid point, it is tangent to the keeper opening 146—as contrasted to the relationship of the wall 24 to the keeper opening 46 in FIG. 8. There, the wall 24 has a groove 47 to accommodate insertion of the keeper—see also FIG. 10.

Figure 11:
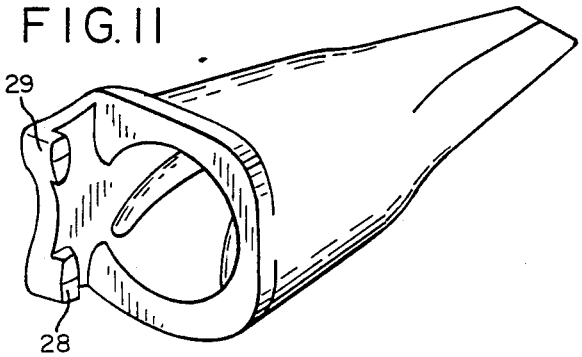
FIG. 11 is a perspective view of a modified form of the inventive point wherein only one side wall is equipped with rearwardly extending ear means.

The ledge 43 (or 143) also serves as a guide during locking pin installation. In this connection I prefer to use a single ear point construction of FIG. 11 with the nose of FIG. 9 this tooth is used primarily for dredging and does not have to be reversible. Here the construction of the lugs 28 and 29 is identical to that of FIG. 3—only the ear means providing the lug portions 30, 31 being omitted.

LOCKING PIN

As indicated previously, the pin C″ differs from the pin C′ (compare FIGS. 2 and 3) in that the pin used with the inventive point has a forward curvature, i.e., is normally bowed. This facilitates the desired rocking action that minimizes nose wear at the area 24.

Figure 12:
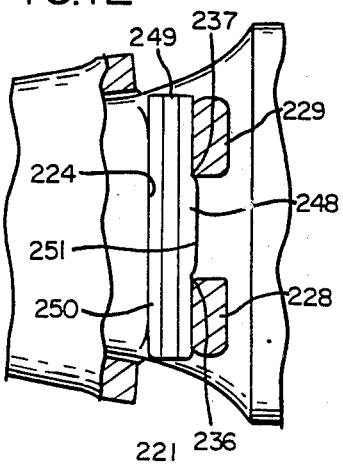
FIG. 12 is a fragmentary side elevational view partially in section of a modified tooth assembly embodying teachings of the invention.

An alternative construction of locking pin 221 is shown in FIG. 12. The point ears of this construction again are of approximately the same length as the rear diameter of the point socket 27, but the forwardly facing lug walls 236 and 237 are not arcuate Rather these lug walls are flat and parallel for use with a sandwich type pin. This sandwich pin, as has been used for many years in the industry, is a laminate of steel plates 248, 250 confining a rubber core 249. This construction does not offer the advantage of rocking engagement with the nose lock groove wall 224 but it would be suitable for light duty applications, and as such, would provide the advantage of operating without a plug D. The pin's retention in assembly is provided by the engagement of the rearward projection 251 on the rear steel laminate 248 with the inward edges 236, 237 of the lugs 228 and 229. Here, it will be appreciated that corresponding lugs are normally provided on the opposite sides of the point, as is a corresponding groove on the nose.

While in the foregoing specification a detailed description of the invention has been set down for the purpose of explanation, many variations in the details hereingiven may be made by those skilled in the art without departing from the spirit and scope of the invention.

I claim:

1. A replacement point for an excavating tooth comprising relatively elongated, unitary body having an earth engaging edge at the forward end thereof and an adapter nose-receiving socket in the rear end defined by top, bottom and a pair of side walls, at least one of said side walls extending rearwardly beyond said top and bottom walls, each of said side walls which extend rearwardly beyond said top and bottom walls having adjacent the top and bottom thereof of vertically spaced upper and lower ear lugs aligned to receive a locking pin.

2. The point of claim 1 in which each ear lug extends inwardly from said side wall at approximately a right angle to said socket for bearing against a locking pin.

3. The point of claim 2 in which said socket has a generally circular cross-section at the rear thereof, the top portion of the upper lug and the bottom portion of the lower lug being spaced apart by approximately the length of the diameter of said circular cross-section.

4. The point of claim 2 in which said lugs each include an inwardly facing wall beveled in the parts thereof adjacent each other to conform to the shape of said socket.

5. The point of claim 4 in which said, lugs each include a forwardly facing wall, the part of the forward wall of the lower lug adjacent the upper lug being rearwardly beveled to guide a locking pin during installation thereof.

6. The point of claim 1 in which both of said side walls extend beyond said top and bottom walls, each sidewall being equipped with said lugs.

7. The point of claim 1 in combination with a nose-equipped adapter, said nose being equipped with a vertically extending groove for the receipt of a locking pin, a relatively vertically elongated locking pin in said groove, said groove having a forward wall in bearing engagement with an intermediate portion of said locking pin and with said point ear lugs being in bearing engagement with said locking pin adjacent the ends of said locking pin.

8. The combination of claim 7 in which said adapter is equipped with a horizontally extending recess aligned with said locking pin, and resilient keeper means for said locking pin in said recess, said recess extending inwardly from said groove.

9. A replacement point for an excavating tooth comprising a relatively elongated, unitary body nose-receiving socket in the rearward end and defined by top, bottom and a pair of sidewalls, at least one of said sidewalls extending rearwardly beyond said top and bottom walls, each of said side walls which extend rearwardly beyond said top and bottom walls having adjacent the top and bottom thereof vertically spaced ear means aligned to bear against an elongated locking pin, each ear means including an integral lug projecting inwardly toward said socket from said side wall, each said lug having a forwardly facing bearing surface, aligned to enter into bearing relation with a locking pin.

10. The point of claim 9 in which said forwardly facing bearing surfaces are arcuate.

11. The point of claim 9 in which said forwardly facing bearing surfaces are planar.

12. A tooth point comprising a relatively elongated, unitary body having an earth engaging edge at the front end and being generally wedge-shaped to provide a rear end having an adapter nose-receiving socket projecting forwardly therefrom, said socket being defined by top, bottom and a pair of sidewalls, each of said sidewalls extending rearwardly beyond the rear and equipped with integral vertically spaced lug portions adjacent the top and bottom of said sidewall extensions, said lug portions extending inwardly at approximately a right angle to said socket and providing an interrupted generally arcuate, fowardly facing bearing surface for bearing against longitudinally spaced areas of a locking pin.

* * * * *